US009320681B2

(12) United States Patent
Dos Santos et al.

(10) Patent No.: US 9,320,681 B2
(45) Date of Patent: Apr. 26, 2016

(54) VETERINARY KIT AND METHOD FOR COMPOUNDING MEDICATED TREATS

(71) Applicant: Medisca Pharmaceutique Inc., Saint-Laurent, Quebec (CA)

(72) Inventors: Antonio Dos Santos, Saint-Laurent (CA); Panagiota Danopoulos, Montreal (CA)

(73) Assignee: MEDISCA PHARMACEUTIQUE INC., Saint-Laurent, Quebec (CA)

( * ) Notice: Subject to any disclaimer, the term of this patent is extended or adjusted under 35 U.S.C. 154(b) by 174 days.

(21) Appl. No.: 13/827,659

(22) Filed: Mar. 14, 2013

(65) Prior Publication Data

US 2013/0292292 A1 Nov. 7, 2013

Related U.S. Application Data

(60) Provisional application No. 61/642,774, filed on May 4, 2012.

(51) Int. Cl.
*A61J 3/00* (2006.01)
*A61J 1/03* (2006.01)

(52) U.S. Cl.
CPC ... *A61J 3/00* (2013.01); *A61J 1/035* (2013.01)

(58) Field of Classification Search
None
See application file for complete search history.

(56) References Cited

U.S. PATENT DOCUMENTS

| | | | | |
|---|---|---|---|---|
| 5,795,610 | A * | 8/1998 | London | 426/512 |
| 7,343,224 | B2 | 3/2008 | DiGianfilippo et al. | |
| 2004/0172169 | A1 | 9/2004 | Wright, IV et al. | |
| 2004/0191276 | A1 | 9/2004 | Muni | |
| 2008/0050479 | A1 * | 2/2008 | Hodge et al. | 426/129 |

* cited by examiner

*Primary Examiner* — Robert A Wax
*Assistant Examiner* — Randeep Singh
(74) *Attorney, Agent, or Firm* — Fraser Clemens Martin & Miller LLC; Jacob M. Ward

(57) ABSTRACT

A kit and method for compounding medicated treats for pet animals includes a first compound, a second compound, a mold assembly, and a blister pack subkit. The first compound includes an edible binding agent for the medicated treat. The second compound includes a nutritional supplement. The first compound and the second compound are admixed together with an auxiliary ingredient, which admixture is formed into the medicated treats using the mold assembly. The mold assembly includes at least a mold plate, a base plate, and a pair of mold clamps. The kit may also include an extractor to facilitate removal of medicated treats from the mold assembly. The blister pack subkit includes a blister pack for receiving the medicated treats, and an adhesive backing for sealing the medicated treats within the blister pack.

16 Claims, 7 Drawing Sheets

VETERINARY KIT AND METHOD FOR COMPOUNDING MEDICATED TREATS

CROSS-REFERENCE TO RELATED APPLICATIONS

This application claims the benefit of U.S. Patent Application No. 61/642,774 filed on May 4, 2012. The entire disclosure of the above application is hereby incorporated herein by reference.

FIELD OF THE INVENTION

The present invention relates to a kit and method for compounding and dispensing custom medicated treats for pet animals.

BACKGROUND OF THE INVENTION

Animals, like humans, are susceptible to a wide range of illnesses and injuries. These illnesses and injuries often requiring medicinal treatment, for the purpose of inducing curative effects or alleviating symptoms.

If a veterinarian wishes to dispense a medication to an animal, such as a pet, the veterinarian may be required to introduce the treatment to the animal orally, in the form of either a medicated tablet or liquid. However, the medication often has characteristics such as a foul odor or taste that make it unappealing to the animal. In such cases, it is typical for the veterinarian to resort to direct administration or trickery to medicate the animal.

Where the direct administration technique is employed, the veterinarian is required to physically seize the animal while attempting to place the medication into the animal's mouth. The animal is then restrained until the medication has been swallowed. For a larger animal, the direct administration of medication may result in agitation, causing the animal to bite or become undesirably apprehensive of the veterinarian.

Trickery is also used by the veterinarian. The trickery may involve a concealing of the medication within a substance more desirable to the animal, such as a treat, or by mixing the medication in the animal's usual fare. This approach is often ineffective, because the animal's senses may alert it to undesirable medication. Even when the veterinarian conceals a small pill within an animal's food, the animal is likely to sense the medication and eat around it, or avoid the food altogether.

There is a continuing need for a system and method of dispensing oral medications to animal such as pets. Desirably, the system and method facilitates a compounding and customization of medicated treats for animals by veterinarians.

SUMMARY OF THE INVENTION

In concordance with the instant disclosure, a system and method of dispensing oral medications to animals such as pets, and which facilitates a compounding and customization of medicated treats for animals by veterinarians, is surprisingly discovered.

In one embodiment, a method of compounding and dispensing a customized medicated treat includes the provision of a first compound and a second compound, and an admixing of the first compound and the second compound with an auxiliary ingredient to form an admixture. The custom admixture is then pressed into a bone shaped mold cavity of a mold plate and left to dry into a medicated treat. Once dried, the mold assembly is disassembled and the medicated treat is extracted from the mold cavity via introduction of an extractor having at least one correspondingly shaped protrusion into the mold cavity, thereby extruding the medicated treat from the mold cavity. The bone shaped medicated treat is then placed into a bone shaped treat compartment of a blister pack and hermetically sealed with an adhesive backing.

In another embodiment, a method of compounding and dispensing a customized medicated treat includes the provision of a first compound and a second compound, and admixing the first compound and the second compound with an auxiliary ingredient to form an admixture. The custom admixture is then pressed into a cylindrical mold cavity of a mold plate and left to dry into a medicated treat. Once dried, the mold assembly is disassembled and a base plate of the assembly is flipped over to expose at least one protrusion to be presented to the mold cavity. The protrusion is next introduced into the mold cavity, thereby extruding the medicated treat from the mold. The cylindrically shaped medicated treat is then placed into a cylindrical treat compartment of a blister pack and hermetically sealed with an adhesive backing.

In yet another embodiment, a kit for compounding and dispensing a customized medicated treat includes a first compound, a second compound, a treat mold assembly for forming bone shaped medicated treats, an extractor, an at least one blister pack, and an at least one adhesive backing. The first compound acts as a binding agent and includes a gelatin, water, and glycerin mixture. The second compound provides nutritional value to the medicated treat and includes an animal food formula. An auxiliary ingredient is provided separately, for example, by a veterinarian or compounding veterinary pharmacist, for treatment of an animal's condition. The treat mold assembly includes a mold plate having bone shaped mold cavities, a base plate, and a pair of mold clamps. The extractor includes a box shaped body having a protrusion from one face thereof, said protrusion having a cross-sectional profile substantially similar to that of a mold cavity of the mold plate. A blister pack is provided having a treat compartment and a planar flange extending therefrom. An adhesive backing is also included in the kit, the adhesive backing including an adhesive substance applied to at least one face to form an adhesive area 52 corresponding to the area of the flange of the blister pack.

In still another embodiment, a kit for compounding and dispensing a customized medicated treat includes a first compound a second compound, and a treat mold assembly for forming cylindrical medicated treats. The first compound acts as a binding agent and includes a gelatin, water, and glycerin mixture. The second compound provides nutritional value to the medicated treat and includes an animal food formula. An auxiliary ingredient may be separately provided, for example, based on a customer request, for admixing with the first compound and the second compound. The treat mold assembly includes a mold plate having cylindrical mold cavities, a base plate having protrusions extending from one face thereof, and a pair of mold clamps. A blister pack is provided having a treat compartment and a planar flange extending therefrom. An adhesive backing is also included in the kit, the adhesive backing including and adhesive substance applied to at least one face in an area corresponding to the area of the flange of the blister pack.

BRIEF DESCRIPTION OF THE DRAWINGS

The above, as well as other advantages of the present invention will become readily apparent to those skilled in the art from the following detailed description of a preferred embodiment when considered in the light of the accompanying drawings including charts, graphs, tables, product specifications, and photographs.

DETAILED DESCRIPTION OF THE INVENTION

Figure 1:
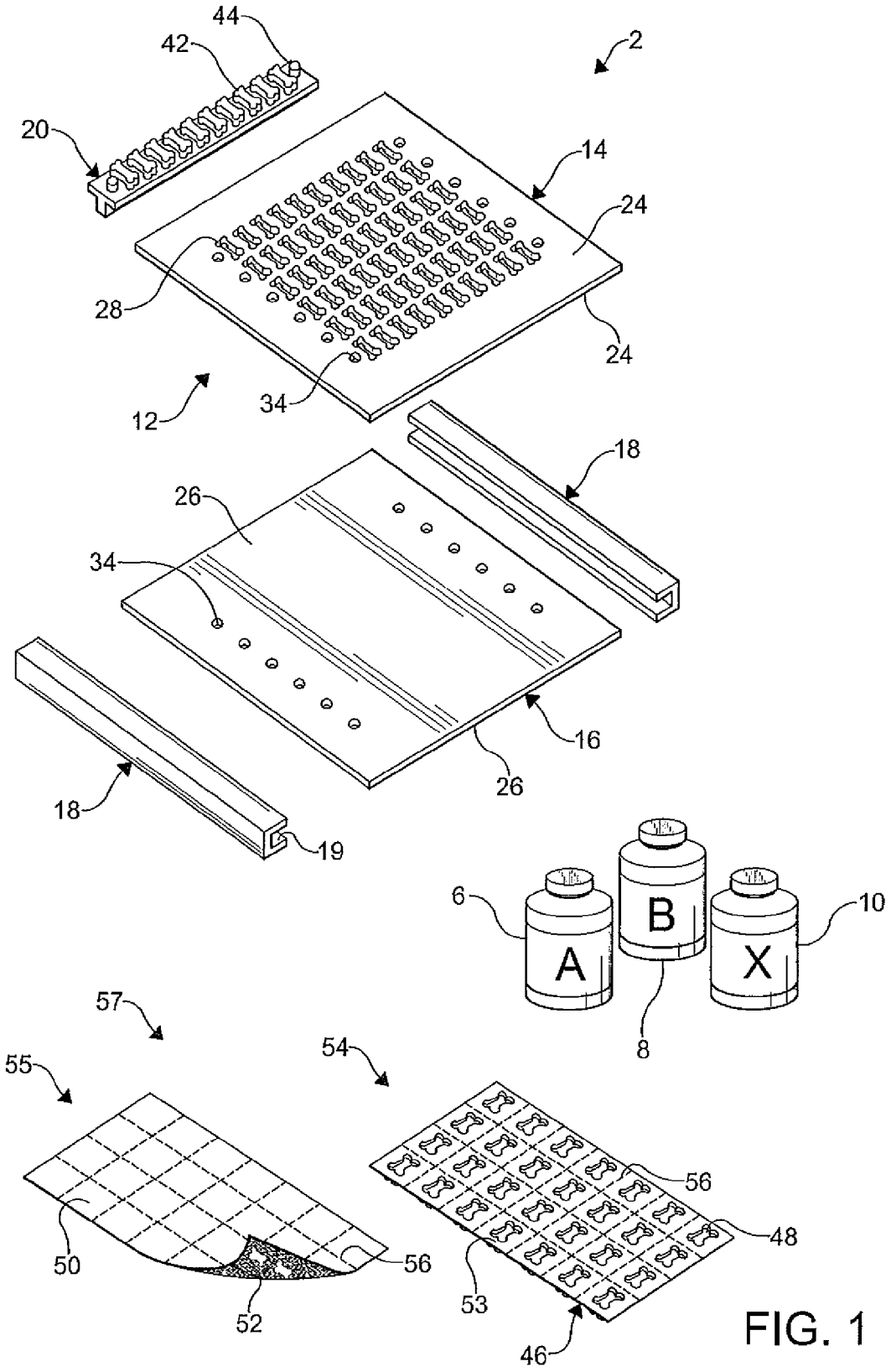
FIG. 1 is a perspective view showing a kit for compounding and dispensing bone shaped medicated treats, in accordance with one embodiment of the present disclosure.

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical unless otherwise disclosed.

In FIGS. 1 to 5F, a veterinary compounding kit 2 for preparing a medicated treat 4 is disclosed. The veterinary compounding kit 2 includes a container of a first compound 6, a container of a second compound 8, a treat mold assembly 12, an extractor 20, and a blister pack subkit 57.

A container of an auxiliary ingredient 10 is provided separate from the kit 2, in most embodiments. For example, the auxiliary ingredient 10 may be selected by a veterinarian or a veterinary compounding pharmacist for purposes of treating a condition of an animal. The auxiliary ingredient 10 may include an active ingredient, such as a medicine, or may be a dietary supplement or nutraceutical, as non-limiting examples. In further embodiments, the auxiliary ingredient 10 may be a flavoring. Other types of auxiliary ingredients 10 may also be used within the scope of the disclosure. In certain embodiments consistent with regulatory requirements, the auxiliary ingredient 10 may also be provided with the kit 2.

The first compound 6 is a binding agent configured to bind together the second compound 8 and auxiliary ingredient 10 in an admixture used to prepare the medicated treat 4. The first compound 6 may have a melting point greater than room temperature, for example, and be processed into solid granules that are heated and melted for incorporation into the admixture. In other embodiments, the first compound 6 is provided as a viscous liquid at room temperature. In particular embodiments, the binding agent includes a gelatin gum base for use in the compounding and formation of medicated treat 4. As one non-limiting example, the first compound 6 includes a pre-mixed blend of gelatin, water, and glycerin. A skilled artisan may select the relative amounts of the gelatin, water, and glycerin, as desired. One of ordinary skill in the art will also appreciate that this first compound 6 may be formulated of any ingredients suitable to function as an edible binding agent, as desired.

The second compound 8 is a nutritional supplement. For example, the second compound may include a blend of ingredients for adding at least one of protein, fat, carbohydrates, vitamins, minerals and other nutrients to the medicated treat 4. The second compound may include a unique, gluten-free ground formula of ingredients such as Omega 6 and 3 fatty acids, as nonlimiting examples. The second compound may also include a blend free of fillers, artificial preservatives, colorings and flavors, as other examples. Advantageously, the nutritional supplement may be provided in a flavorless form so that the veterinarian may customize the medicated treats 4 with a desired flavoring.

In a particular embodiment, the second compound 8 includes a ground animal food. The animal food may be in the form of a finely divided powder, or in the form of coarse granules, as nonlimiting examples. Other types of nutrients and forms of the second compound 8, for example, used to accommodate a variety of animals, including pets and livestock, are also contemplated and within the scope of the present disclosure.

Where the veterinarian or compounding veterinary pharmacist selects an active ingredient as the auxiliary ingredient 10, the auxiliary ingredient 10 may include a medicine to be included in the medicated treat 4 for treatment of a medical condition or illness of an animal. In another example, the auxiliary ingredient 10 may include a pain relieving formula to minimize physical discomfort of the animal. One of ordinary skill in the art will appreciate that the auxiliary ingredient 10 may include any substance that one may wish to provide to the animal for consumption, for purposes of treating the medical condition or illness, for example.

The treat mold assembly 12 of the present disclosure includes a mold plate 14, a base plate 16, and an at least one mold clamp 18. In a particular embodiment, the mold plate 14 has a rectangular cross section, with a pair of planar mold faces 24 disposed parallel to and opposite each other. A distance spanning the opposing mold faces 24 defines a thickness of the mold plate 14. In a particular example, the thickness of the mold plate 14 measures between one-eighth of an inch (118") and one inch (1"). Other thicknesses may also be used within the scope of the disclosure.

It should be appreciated that the mold plate 14 may be provided in any shape capable of containing an at least one mold cavity 28. In the embodiment shown, the mold plate 14 has a main body that is substantially square or rectangular in shape. However, in other embodiments, the main body of the mold plate 14 may be provided in a circular or oval shape, with the at least one mold cavity 28 extending through the planar faces of main body, as desired. Other shapes for the main body of the mold plate 14 may also be used within the scope of the disclosure.

Figure 2:
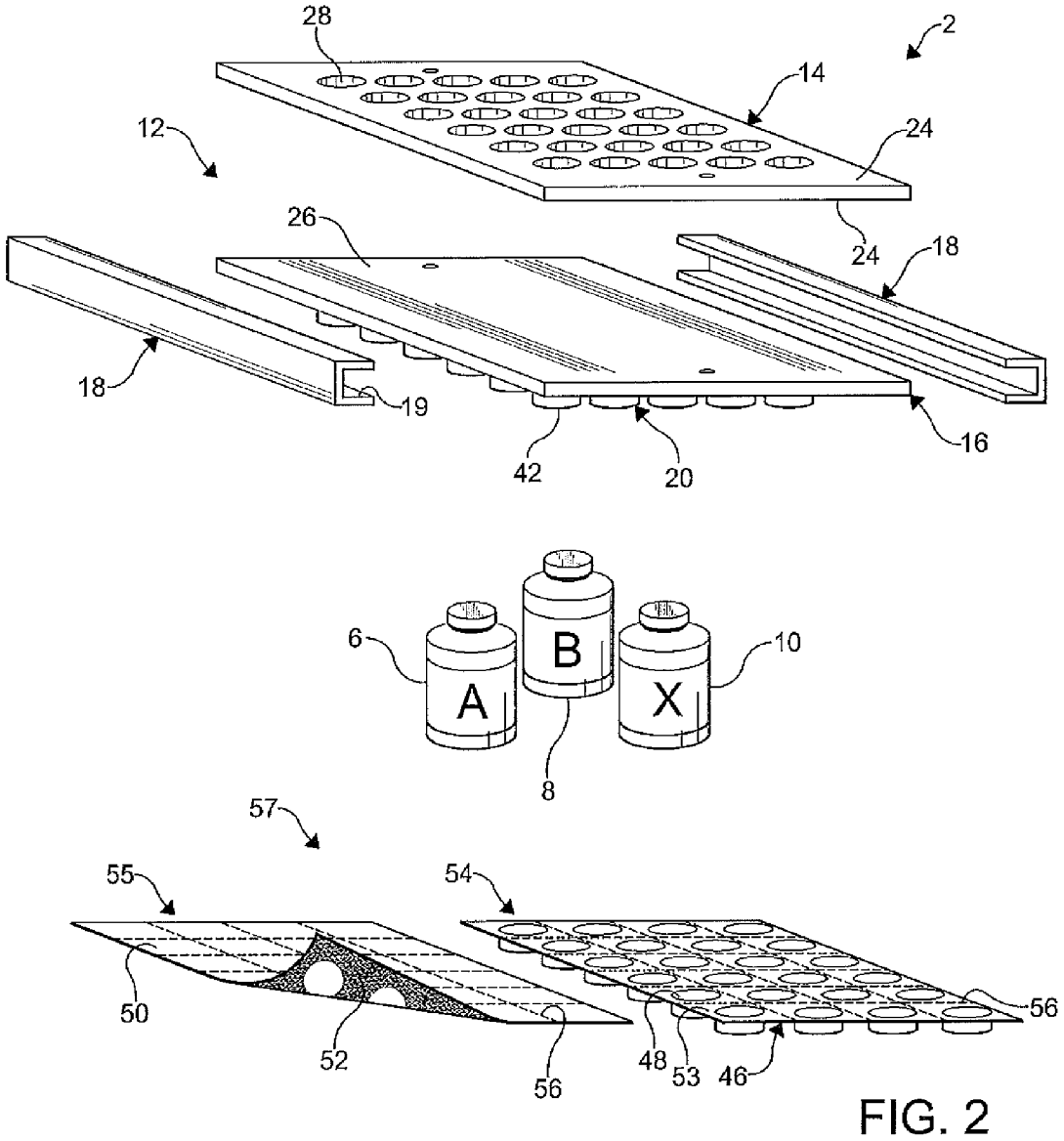
FIG. 2 is a perspective view showing a kit for compounding and dispensing cylindrical medicated treats, in accordance with another embodiment of the present disclosure.

The mold plate 14 includes the at least one mold cavity 28. The mold cavity 28 may be a hole or opening that extends through the thickness of the mold plate 14, for example. The mold cavity 28 is configured to provide a desired shape to the medicated treat 4 upon preparation according to the method of the present disclosure. As shown in FIG. 1, the at least one mold cavity 28 may have a cross-sectional profile of a bone. The mold cavity 28, shaped thusly, permits a formation of a bone shaped medicated treat 4 when the admixture is pressed into the mold cavity 28. With reference to FIG. 2, the at least one mold cavity 28 may have a circular cross-sectional profile, and permit a formation of a cylindrical shaped medicated treat 4. One of ordinary skill in the art may select other shapes for the at least one mold cavity 28, as desired.

The mold plate 14 may include a plurality of the mold cavities 28. For example, the plurality of mold cavities 28 may be arranged in a series of columns and rows along a mold face 24 of the mold plate 14. The mold plate 14 further includes at least one guide aperture 34 for receiving a corresponding guide member 44 of the extractor 20, an operation of which is described further herein.

A plurality of the guide apertures 34 may also be aligned adjacent the columns of the mold cavities 28. For example, a corresponding pair of guide apertures 34 may bound the mold cavities 28. In one embodiment, as shown in FIG. 1, a first column of the guide apertures 34 may be disposed adjacent a leading column of the mold cavities 28 at one side of the mold plate 14, and a second column of the guide apertures 34 may be disposed adjacent a trailing column of the mold cavities 28 at another side of the mold plate 14. In other embodiments, the pair of guide apertures 34 may be included at the beginning and end of each row of mold cavities 28, or may be spaced evenly such that one pair of corresponding guide apertures 34 is associated with multiple rows of mold cavities 28. Other suitable configurations of the guide apertures may be selected by a skilled artisan, as desired.

The treat mold assembly 12 further includes a base plate 16. The base plate 16 has a main body of a substantially similar size and shape as the main body of the mold plate 14. The base plate 16 has at least one planar face 26 that functions as a bottom surface of the mold cavity 28 when the treat mold assembly 12 is assembled.

Like the mold plate 14, the base plate 16 may include the at least one guide aperture 34 for receiving the guide member 44 of the extractor 20. The quantity and configuration of the at least one guide aperture 34 of the base plate 16 may correspond to the quantity and configuration of the at least one guide aperture of the mold plate 14. This permits an insertion of the guide member 44 through the aligned guide apertures 34 of the mold plate 14 and base plate 16 when the treat mold assembly 12 is assembled.

The treat mold assembly 12 may further include at least one mold clamp 18. The at least one mold clamp 18 is configured for holding the mold plate 14 and the base plate 16 together during use, where the medicated treat 4 is formed. As shown in FIGS. 1 and 2, the at least one mold clamp 18 may includes a pair of mold clamps 18, each of the pair of mold clamps 18 defined by a substantially U-shaped channel 19 which recites the combined thicknesses of the mold plate 14 and the base plate 16 where the mold plate 14 and base plate 16 are assembled. Other types of mold clamps 18 may also be used within the scope of the present disclosure.

The veterinary compounding kit 2 of the present disclosure may also include the extractor 20. The extractor 20 is configured for removal of the medicated treat 4 from the mold cavity 28 of the mold plate 14 following the formation of the medicated treat 4. The extractor 20 may be included as a separate tool in the veterinary compounding kit 2 (shown in FIG. 1), or may be integral with a portion of the treat mold assembly 12 (shown in FIG. 2), as desired.

In a particular example, the extractor 20 may be an elongate tool having an at least one protrusion 42 extending outwardly therefrom. The protrusion 42 may have a cross-sectional profile of a substantially similar shape as that of the at least one mold cavity 28 of the base plate 16. The protrusion 42 may have a reduced size relative to the at least one mold cavity 28 that provides a clearance between the protrusion 42 and an inner wall of the mold cavity 28, thereby allowing the protrusion 42 to be easily inserted into the mold cavity 28. For example, when the mold cavity 28 is of a bone shaped profile, the at least one protrusion 42 may be of a smaller bone shaped profile.

In certain embodiments, the extractor 20 includes a plurality of the protrusions 42 aligned along an at least one row corresponding to one or more rows of the plurality of mold cavities 28 formed in the mold plate 14. One of ordinary skill in the art will appreciate that the extractor 20 may include multiple rows of protrusions 42 for engagement with multiple rows 32 of mold cavities 28, permitting the user to extract a plurality of the medicated treats 4 in a single operation.

The extractor 20 may also includes the at least one guide member 44, to be received by the at least one guide aperture 34 as described hereinabove. The at least one guide member 44 may have a circular cross-section of a slightly lesser diameter than that of the guide aperture 34 of the corresponding mold plate 14 and base plate 16. The smaller at least one guide member 44 facilitates an ease in insertion of the at least one guide member 44 into the at least one guide aperture 34.

In a particular embodiment, the extractor 20 includes a pair of cylindrical guide members 44 configured to be inserted into a corresponding pair of guide apertures 34. The corresponding pairs of cylindrical guide members 44 and guide apertures 34 align the at least one protrusion 42 with the at least one mold cavity 28 during extraction 120 of medicated treats 4 from the mold plate 14.

In a further embodiment, as shown in FIG. 2, the extractor 20 is integrally formed with the base plate 16 on a surface opposing the planar face 26. The plurality of protrusions 42 are formed on the base plate 16, and may correspond in quantity and configuration to the mold cavities 28 of the respective mold plate 14. It will be appreciated by a skilled artisan that the extractor 20 may be integrated into any one of the mold assembly 12 components, such as a mold clamp 18 or mold plate 14, as desired.

The veterinary compounding kit 2 of the present disclosure may also include the blister pack subkit 57. The blister pack subkit 57 is configured for the formation of an assembled blister pack product having the medicated treat 4 secured within for storage and subsequent administering of the medicated treat 4 to the animal. The blister pack subkit 57 may include an at least one blister pack 54 and an at least one adhesive backing sheet 55.

The blister pack 54 includes a main body 46 having an at least one treat compartment 48 and flange 53. The main body 46 of the blister pack 54 may be formed from a thin plastic sheet, and the at least one adhesive backing sheet 55 may include a thin metal foil 50, as nonlimiting examples. The main body 46 of the blister pack 54 may be provided in an amber color for UV inhibition, for example. The at least one adhesive backing sheet 55 may be provided with laser labels for medication identification (in 8.5"×11" sheets), for example. The thin metal foil 50 may include a cold seal, tamper-evident foil labels designed to meet USP Class B requirements. Other types of blister packs 54 and adhesive backing sheets 55 may also be employed, as desired.

The treat compartment 48 of the blister pack 54 may be formed with a shape corresponding to a shape of the medicated treat 4. For example, as shown in FIG. 1, the treat compartment 48 may be bone shaped in cross-section and configured to receive the bone shaped medicated treat 4. In another example, as shown in FIG. 2, the treat compartment 48 may be circular in cross-section and configured to receive the cylindrical shaped medicated treat 4. A skilled artisan may select other suitable shapes for the treat compartment 48 of the blister pack 54, as desired.

The depth of the treat compartment 48 is sufficient for the medicated treat 4 to sit entirely within the treat compartment 48. This allows the adhesive backing sheet 55 to be attached to the blister pack 54 over the opening of the treat compartment 48. For example, a flange 53 of the blister pack 54 extends outwardly from the upper edge of the treat compartment 48, and may provide a planar surface for attachment of the adhesive backing sheet 55.

As shown in FIGS. 1 and 2, the blister pack 54 may include a plurality of the treat compartments 48, which may be joined together at the boundaries of the respective flanges 53. Individual treat compartments 48 may be joined by perforations 56 that run a length and a width of the blister pack 54. The perforations 56 may segregate adjacent treat compartments 48, and allow specified quantities of the treat compartments 48 to be separated from the blister pack 54.

The at least one adhesive backing sheet 55 is included for sealing the at least one blister pack 54. In one example, the adhesive backing sheet 55 includes an adhesive 52 substance applied to a face of the adhesive backing sheet 55 in an area corresponding to the surface area of the flange 53.

It should be appreciated that the adhesive 52 may not be applied to the face of the adhesive backing sheet 55 in locations that would be placed in contact with the contents of the treat compartments 48 in use. The adhesive backing sheet 55 when applied to the blister pack 54 may be adhered to the blister pack 54 without adhering to the medicated treat 4 contained therein. For example, as shown in FIG. 1, the adhesive backing sheet 55 to be applied to the blister pack 54 with bone shaped treat compartments 48 may have the dog bone shaped areas of non-adhesive surrounded by the adhesive area 52. In another example, as shown in FIG. 2, the adhesive backing sheet 55 to be applied to the blister pack 54 with circular compartments 48 may have the circular shaped areas of non-adhesive surrounded by the adhesive area 52.

In a particular embodiment, the at least one foil 50 cover is perforated along substantially the same perforation lines as that of the blister pack 54. The separation of the blister pack 54 into portions having different numbers of treat compartments 48, while maintaining the medicated treats 4 sealed within the treat compartments 48, is thereby facilitated.

Figure 3:
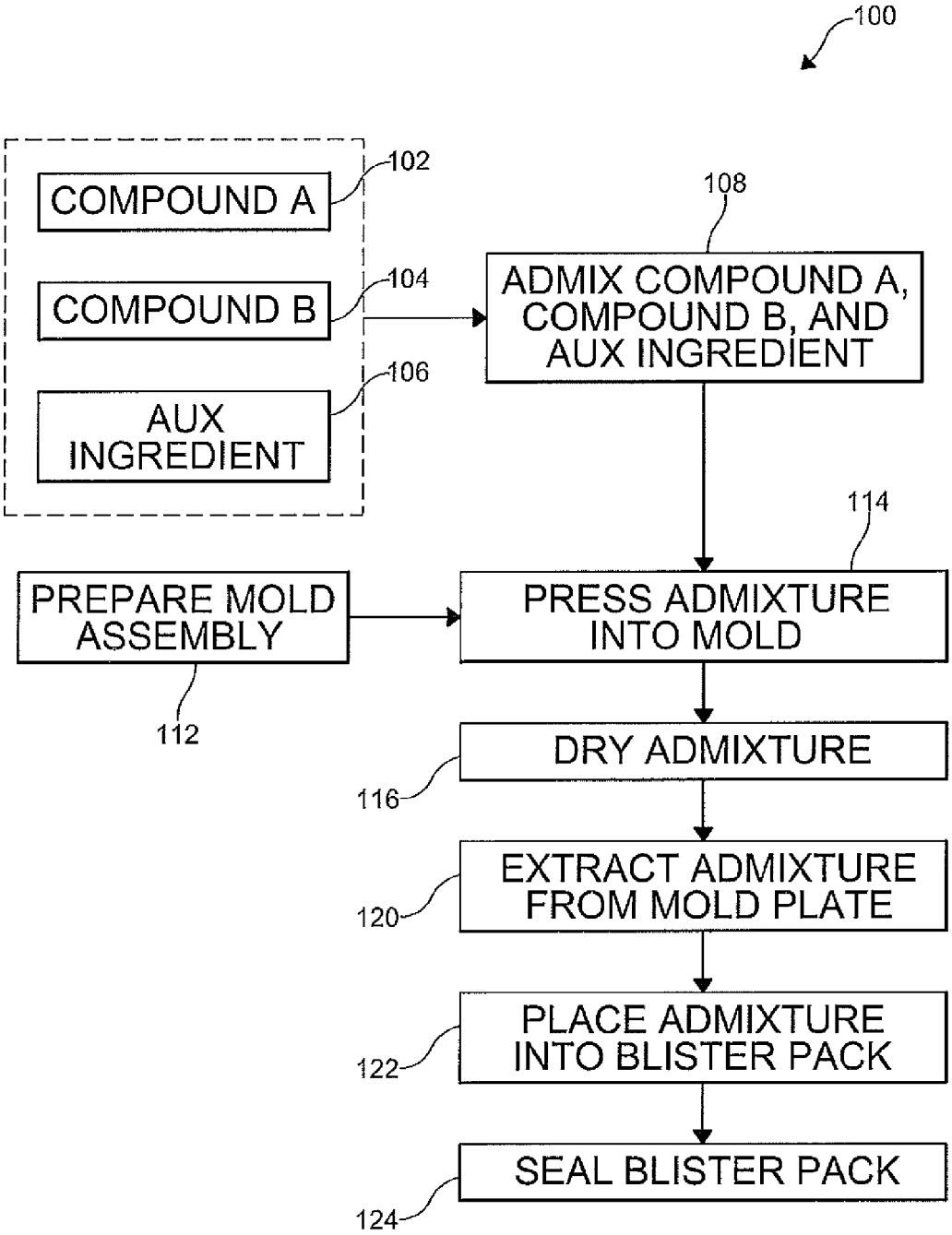
FIG. 3 is a flow diagram of a method for compounding and dispensing a medicated treat in accordance with the present disclosure.

The present disclosure further includes a method 100 for forming the medicated treat 4 for the animal. As shown in FIG. 3, the method 100 includes a provision 102 of the first compound 6, a provision 104 of the second compound 8, and a provision of the auxiliary ingredient 10. The provided components are then combined in an admixing step 108 to formulate the medicated treat 4. It should be understood that the particular ratios of the first compound 6 to the second compound 8, and the ultimate concentration of the auxiliary ingredient 10 in the admixture, may be selected by one of ordinary skill in the art to provide the medicated treat 4 of the desired consistency and efficacy.

It should be understood that the method 100 of the present disclosure may be performed using the veterinary compounding kit 2 having a separate extractor tool 20, as shown in FIGS. 4A to 4F, or by using the veterinary compounding kit 2 having an integral extractor 20, as shown in FIGS. 5A to 5F, as desired. It is further contemplated that the various components may be provided separately or as part of a different type of kit, and may likewise be employed with the method 100 of the present disclosure.

One of ordinary skill in the art should understand that the admixture may require heating in order to become a pliable mixture capable of being placed in the treat mold assembly 12. In one nonlimiting example, where the heating is necessary, the admixture may be heated to a temperature between about 40° C. and 80° C., more particular between about 50° C. and about 70° C., and most particularly between about 60° C. and 65° C., prior to placement in the treat mold assembly 12. A skilled artisan may select other suitable temperatures for using the admixture, as desired.

Where the veterinary compounding kit 2 is employed, the method 100 may include an assembly step 112 that includes the preparation of the treat mold assembly 12 by aligning the mold plate 14 over the base plate 16 such that the mold face 24 of the mold plate 14 abuts the planar face 26 of the base plate 16. The mold plate 14 and the base plate 16 are then secured by inserting the combined mold and base plates 14, 16 into the U-shaped channels 19 of the mold clamps 18.

Either prior to, or after, the assembly step 112, the treat mold assembly 12 may be pre-treated to ensure an ease in removing the medicated treats 4. For example, the mold surfaces (including mold cavities 28) of the treat mold assembly 12 may be lubricated prior to the molding operation. The extractor 20 may also be lubricated prior to molding. Fixed oils, such as canola, vegetable, palm and sesame seed, are nonlimiting examples of suitable lubricants. The wearing of gloves may be advisable in this step, as a proper lubrication may be performed using thumbs, forefingers and palms. Where the base plate 16 starts to stick, it should be appreciated that gloves may be replaced and the lubrication continued.

Upon assembly and pre-treatment of the treat mold assembly 12, the medicated treat 4 admixture is pressed in a pressing step 114 into the at least one mold cavity 18 of the mold plate 14 such that the admixture is fills the mold cavity 28 flush with the mold face 24 of the mold plate 14. The admixture may be scooped into predetermined portions, for example, marble-size quantities, and pressed by hand or appropriate tools into the mold cavity 28. The forming of predetermined portions may be performed by rolling the admixture between a thumb and forefinger to form a cylinder. The cylinders may be pressed into the individual mold cavities 28 of the specified mold until they are completely filled, for example. A pressure sufficient to remove large air pockets from the admixture, or to create a desired density of the medicated treat 4, may be applied, as desired. If the admixture starts to solidify while filling, the admixture may be reheated as necessary, and the process continued. The extractor 20 may also be used as a compactor to ensure uniformity of the admixture in the mold cavities 28. Using a rubber or plastic (e.g., PVC) spatula or scraper, any excess admixture may be removed.

Following the pressing of the admixture into the mold cavity 28, the formed admixture defining the medicated treat 4, the medicated treat 4 is then allowed to dry 116. For example, at least a portion of the treat mold assembly 12 containing the medicated treat 4 may be permitted to sit at a controlled room temperature and relative humidity, for example, for a predetermined period of time or until dry through testing. In another example, at least a portion of the treat mold assembly 12 containing the treat 4 may be placed in the path of air movement, for example, caused by a fan, to increase a drying rate. It should be appreciated that the treat mold assembly 12 may not be placed in an oven, as this may cause an undesirable warping.

Once the medicated treat 4 has been sufficiently dried, such that integrity of the medicated treat 4 may be maintained upon removal from the mold cavity 28, the mold clamps 18 are removed from the treat mold assembly 12. It should be appreciated that the removal of the mold clamps 18 allows the mold plate 14 to be separated from the base plate 16, and for a subsequent extraction of the medicated treat 4.

The dried medicated treat 4 is next removed from the mold plate 14 in an extraction step 120. In one embodiment, illustrated in FIGS. 4D and 4E, the extraction 120 is facilitated by inserting the guide member 44 of the separate extractor tool 20 into the corresponding guide aperture 34 of the mold plate 14. The extractor tool 20 and the mold plate 14 are then united, thereby introducing the protrusions 42 into the mold cavities 28, and pushing the medicated treats 4 from the mold cavities 28.

Figures 5A, 5B, 5C:
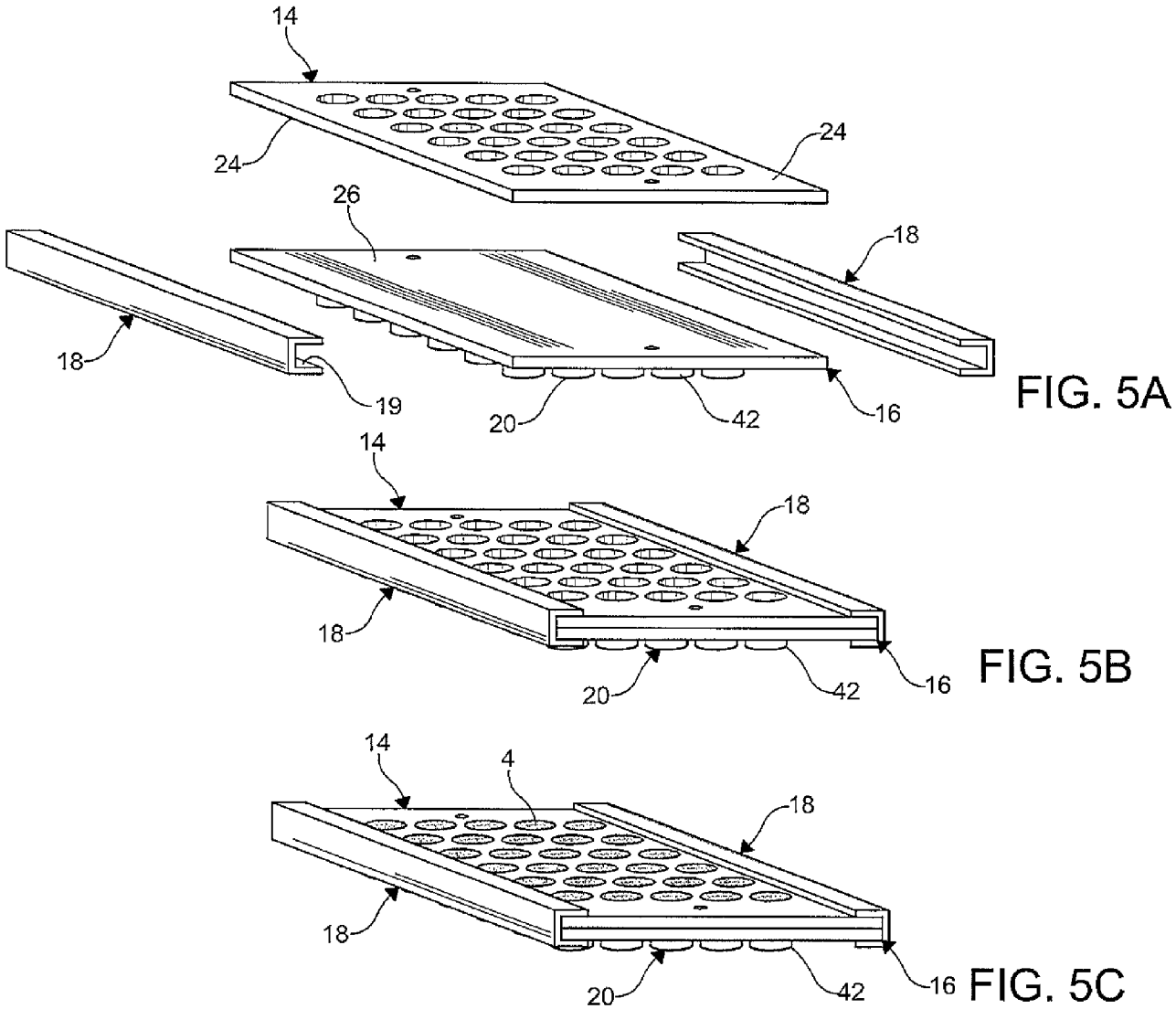
FIG. 5A is an exploded perspective view of a mold assembly for forming cylindrical medicated treats assembly.
FIG. 5B is a perspective view of the mold assembly shown in FIG. 5A, the mold assembly shown assembled and prior to forming cylindrical medicated treats
FIG. 5C is a perspective view of the mold assembly shown in FIGS. 5A and 5B, the mold assembly shown assembled and containing the cylindrical medicated treats.
Figure 5D:
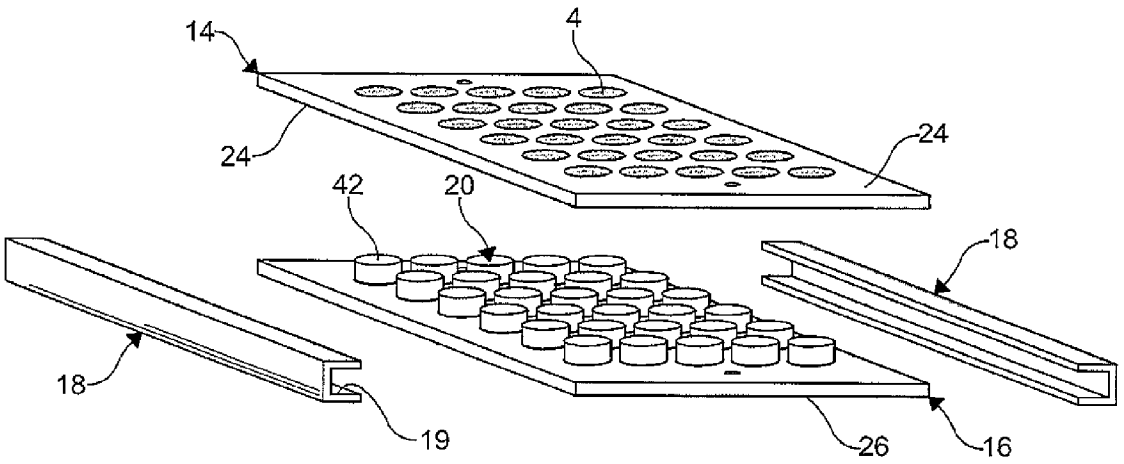
FIG. 5D is an exploded perspective view of the mold assembly shown in FIGS. 5A to 5C, the mold assembly shown disassembled and containing the cylindrical medicated treats.
Figure 5E:
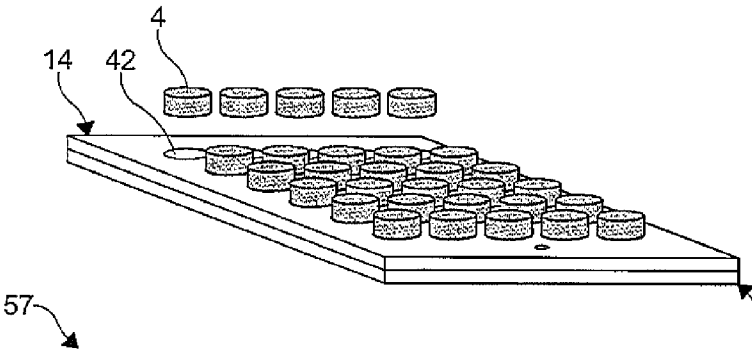
FIG. 5E is a perspective view of a mold plate of the mold assembly shown in FIGS. 5A to 5D, illustrating a removal of the cylindrical medicated treats from the mold plate a base plate having integral extractors.

In another example, illustrated in FIGS. 5D and 5E, the mold assembly 12 is disassembled after the medicated treat 4 is dried 116 and the base plate 16 is turned over to expose the integrated extractor 20. The protrusions 42 of the integrated extractor 20 are thereby presented to the mold cavities 28 of the mold plate 14. Upon alignment of the protrusions 42 with corresponding mold cavities 28, the mold plate 14 and base plate 16 are united, thus introducing the protrusions 42 into the respective mold cavities 28 and pushing the medicated treats 4 from the mold cavities 28.

In a packaging step 122, the medicated treat 4 is next placed into the blister pack 54. In one example, depicted in FIG. 4F, the medicated treat 4 having a bone shaped profile is placed into the blister pack 54 having the corresponding treat compartment 48 with the bone shaped profile. In another example, depicted in FIG. 5F, the medicated treat 4 having the cylindrical shape is placed into the blister pack 54 having the corresponding cylindrical shaped treat compartment 48.

With the medicated treats 4 placed into the treat compartment 48 of the blister pack 54, the adhesive area 52 of the adhesive backing sheet 55 is joined to the flange 53 of the blister pack 54 in a manner that hermetically seals the treat compartment 48 from the open atmosphere. The medicated treat 4 is then ready to be dispensed by veterinary personnel, owners, or caretakers.

Figure 4B:
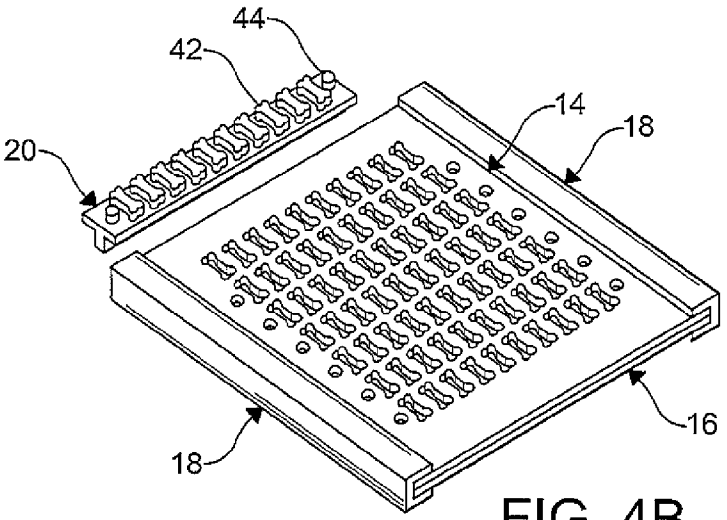
FIG. 4B is a perspective view of the mold assembly shown in FIG. 4A, the mold assembly shown assembled and prior to forming bone shaped medicated treats.
Figure 4C:
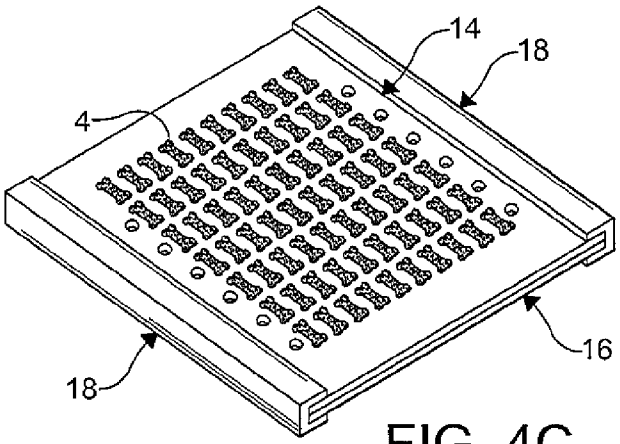
FIG. 4C is a perspective view of the mold assembly shown in FIGS. 4A and 4B, the mold assembly shown assembled and containing the bone shaped medicated treats.
Figure 4A:
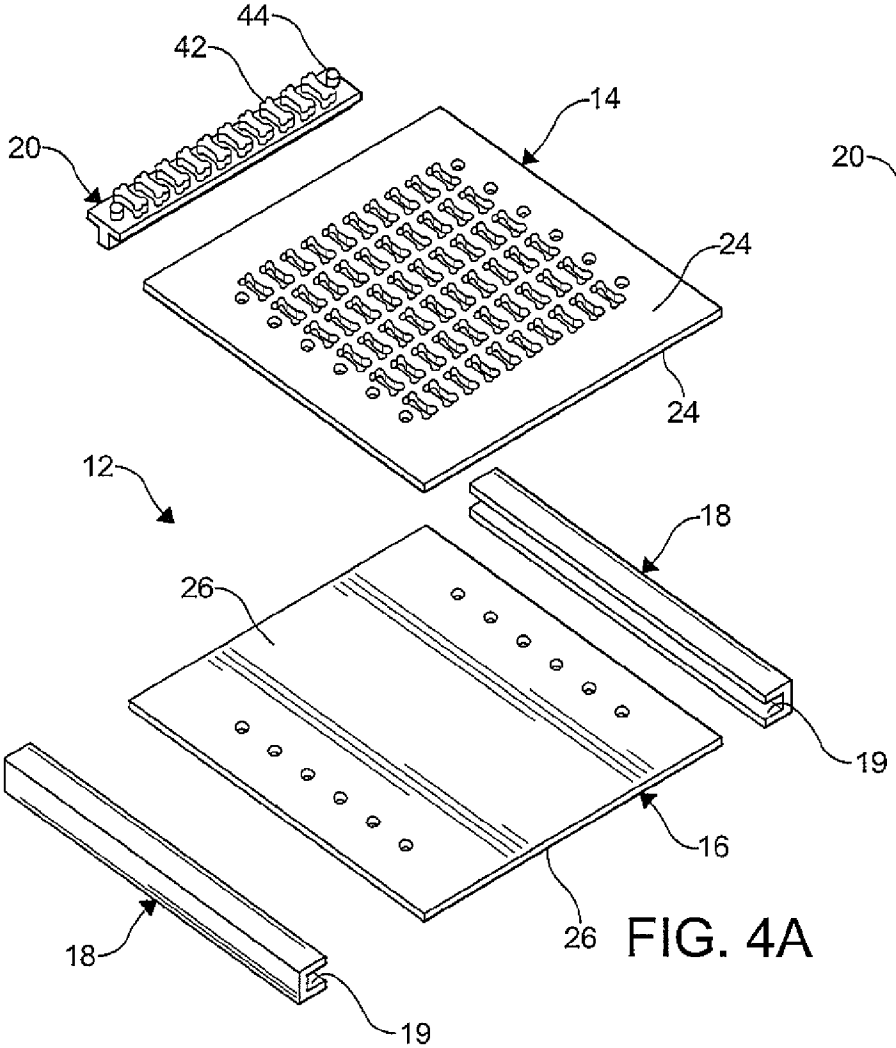
FIG. 4A is an exploded perspective view of a mold assembly of the kit shown in FIG. 1, the mold assembly for forming bone shaped medicated treats.
Figure 4E:
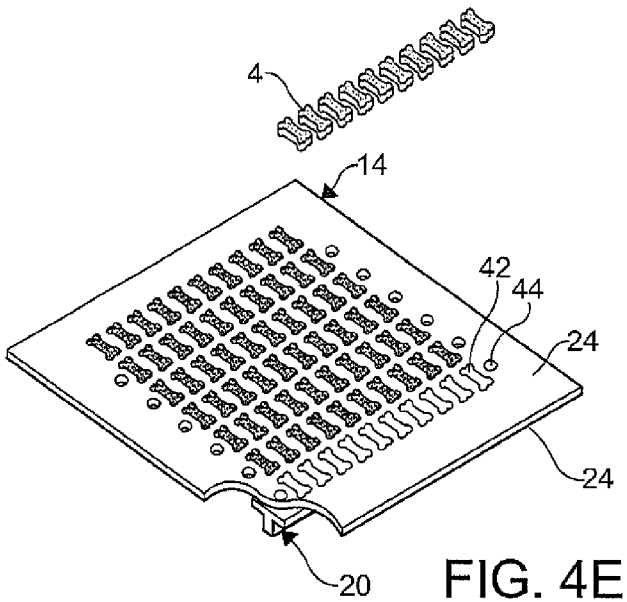
FIG. 4E is a perspective view of a mold plate of the mold assembly shown in FIGS. 4A to 4D, illustrating a removal of the bone shaped medicated treats from the mold plate with an extractor.
Figure 4F:
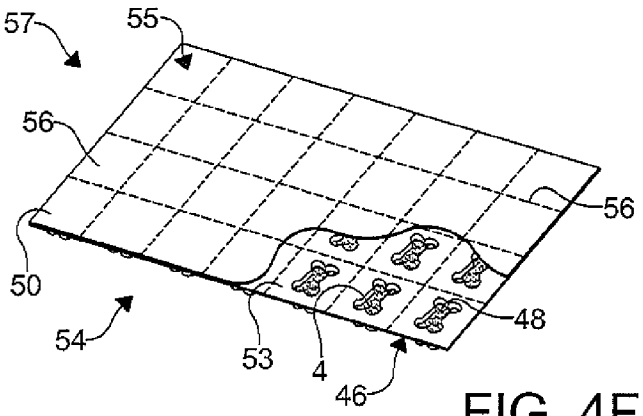
FIG. 4F is a perspective view of a sealed blister pack containing the bone shaped medicated animal treats following formation and removal from the mold assembly shown in FIGS. 4A to 4E, an adhesive backing sheet illustrated having a portion broken away for purposes of showing the underlying bone shaped medicated animal treats in the blister pack.
Figure 4D:
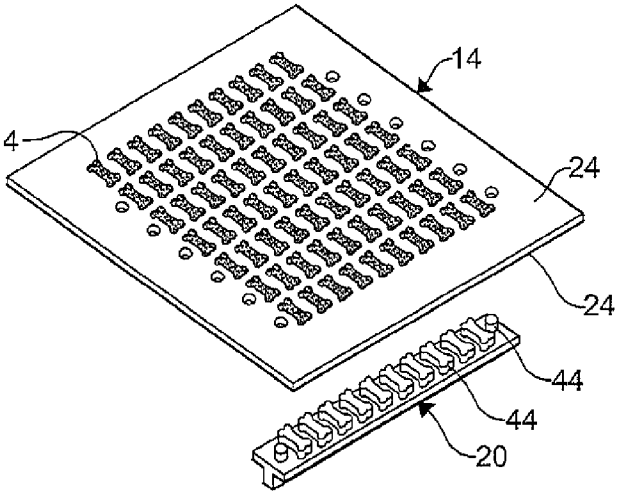
FIG. 4D is an exploded perspective view of the mold assembly shown in FIGS. 4A to 4C, the mold assembly shown disassembled and containing the bone shaped medicated treats.
Figure 4D:
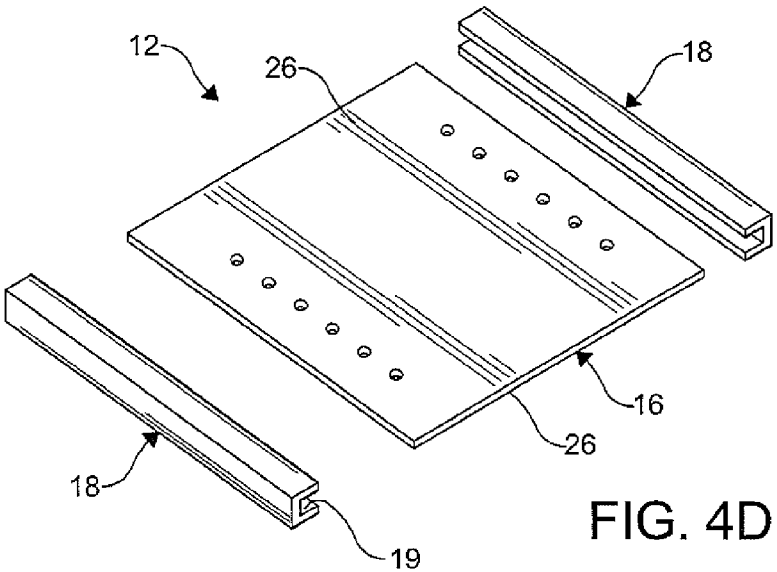

In FIGS. 4A-4F, a stepwise illustration of the method 100 using the veterinary compounding kit of FIG. 1 is shown. In FIG. 4A, the treat mold assembly 12 is in a disassembled state. The treat mold assembly 12 is then prepared by assembling the mold plate 14, the base plate 16, and the mold clamps 18 as shown in FIG. 4B. Once the mold assembly 12 is assembled, the admixture for the medicated treat 4 is pressed into the mold cavities 28 of the mold plate 14. After a drying period, the treat mold assembly 12 is disassembled by removing the mold clamps 18 and separating the mold plate 14 from the base plate 16, for example, as shown in FIG. 4D. The FIG. 4E next illustrates the extraction of the medicated treats 4 from the mold cavities 28 by aligning the guide cylinders 44 of extractor tool 20 with the guide apertures 34 of the mold plate 14, and subsequently uniting the extractor 20 and mold plate 14 to introduce the protrusions 42 into the mold cavities 28. The medicated treats 4 are thereby extruded from the mold cavities 28. The extracted medicated treats 4 are then placed 122 into the treat compartments 48 of the blister pack 54 as shown in FIG. 4F. The blister pack 54 is subsequently hermetically sealed by applying the adhesive area 52 of the adhesive backing sheet 55 to the flange 53 of the blister pack 54. The blister pack 54 having the medicated treats 4 is thereby provided.

Figure 5F:
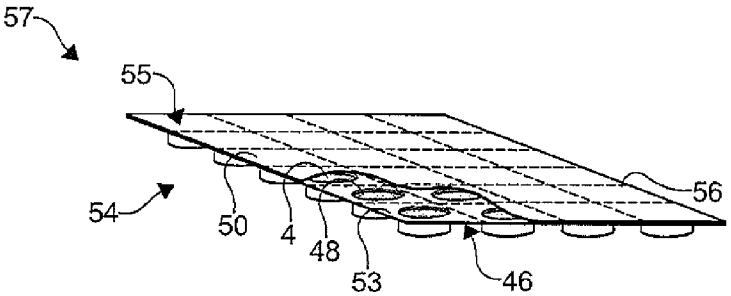
FIG. 5F is a perspective view of a sealed blister pack containing the cylindrical medicated treats following formation and removal from the mold assembly shown in FIGS. 5A to 5E, an adhesive backing sheet illustrated having a portion broken away for purposes of showing the underlying cylindrical medicated treats in the blister pack.

In FIGS. 5A-5F, a stepwise illustration of the method 100 using the veterinary compounding kit of FIG. 2 is shown. In FIG. 5A, a treat mold assembly 12 of the present example is shown in a disassembled state. The treat mold assembly 12 is then assembled as shown in FIG. 5B, and in FIG. 5C the admixture is pressed into the mold cavities 28 of the mold plate 14. After a drying period, the treat mold assembly 12 is disassembled by removing the mold clamps 18 and separating the mold plate 14 from the base plate 18, for example, as shown in FIG. 5D. With the base plate 16 flipped, such that the protrusions 54 are exposed to the mold cavities 28 of the mold plate, the protrusions 54 are then aligned with the respective mold cavities 28 and the base plate 16 is pressed against the mold plate 14. The admixture is thereby extruded from the mold in the form of the medicated treats 4. The extracted medicated treats 4 are then placed into the treat compartments 48 of the blister pack 54, as shown in FIG. 5F. The blister pack 54 is subsequently hermetically sealed by applying the adhesive area 52 of the adhesive backing sheet 55 to the flange 53 of the blister pack 54. The blister pack 54 having the medicated treats 4 is thereby provided.

Advantageously, and as established in the examples hereinabove, the veterinary compounding kit 2 and method 100 of the present disclosure facilitates the preparation and dispensing of medicated treats 4 for consumption by animals such as pets. The veterinary compounding kit 2 and method 100 is surprisingly effective in facilitating the consumption of medication by the animals without the need for restraint or trickery on the part of person administering the medication.

While certain representative embodiments and details have been shown for purposes of illustrating the invention, it will be apparent to those skilled in the art that various changes may be made without departing from the scope of the disclosure, which is further described in the following appended claims.

What is claimed is:

1. A veterinary compounding kit, comprising:

a container having a first compound including a binding agent;

a container having a second compound including a nutritional supplement; and a mold assembly for forming a medicated treat including the first compound and the second compound, the mold assembly including a mold plate with at least one mold cavity, a base plate, and at least one mold clamp, the at least one mold clamp configured to hold together the mold plate and the base plate during the forming of the medicated treat, the base plate having a first face, a second face, and at least one extractor for removing the medicated treat from the mold assembly following the forming of the medicated treat, the first face of the base plate being substantially planar, the extractor disposed on the second face and integral with base plate, the extractor including at least one protrusion.

2. The veterinary compounding kit of claim 1, further comprising a blister pack subkit including an at least one blister pack and an at least one adhesive backing sheet.

3. The veterinary compounding kit of claim 1, wherein the at least one mold cavity is bone shaped.

4. The veterinary compounding kit of claim 1, wherein the at least one mold cavity is cylindrical shaped.

5. The veterinary compounding kit of claim 1, further including a container having an auxiliary ingredient.

6. The veterinary compounding kit of claim 1, wherein the first compound includes a gelatin gum.

7. The veterinary compounding kit of claim 1, wherein the second compound includes a ground animal food.

8. The veterinary compounding kit of claim 1, wherein the protrusion has a cross-sectional profile substantially similar to that of the at least one mold cavity of the mold plate.

9. The veterinary compounding kit of claim 1, wherein the at least one mold clamp includes a U-shaped channel for receiving both the base plate and the mold plate.

10. The veterinary compounding kit of claim 1, wherein the mold plate has a plurality of the mold cavities, and the second face of the base plate has a corresponding plurality of the protrusions.

11. The veterinary compounding kit of claim 10, wherein the mold cavities are arranged in a series of columns and rows along a mold face of the mold plate, and the protrusions are arranged in a corresponding series of columns and rows along the second face of the base plate.

12. The veterinary compounding kit of claim 1, wherein the mold plate and the base plate each has cooperating guide features that permit the at least one mold cavity of the mold plate to be aligned with the at least one protrusion of the base plate for extrusion of the medicated treat following the forming of the medicated treat.

13. The veterinary compounding kit of claim 1, wherein the second face is disposed on an opposite side of the base plate relative to the first face.

14. A method for forming a medicated treat for an animal, the method comprising the steps of:

providing a veterinary compounding kit including a container having a first compound including a binding agent, a container having a second compound including a nutritional supplement, and a mold assembly for forming the medicated treat including the first compound and the second compound, the mold assembly including a mold plate with at least one mold cavity, a base plate, and at least one mold clamp, the at least one mold clamp configured to hold together the mold plate and the base plate during the forming of the medicated treat, the base plate having a first face, a second face, and at least one extractor for removing the medicated treat from the mold assembly following the forming of the medicated treat, the first face of the base plate being substantially planar, the extractor disposed on the second face and integral with base plate, the extractor including at least one protrusion;

combining the first compound and the second compound to form a medicated treat admixture;

assembling the mold assembly by clamping the mold plate and the base plate together with the at least one mold clamp, the first face of the base plate abutting the mold plate;

pressing the medicated treat admixture into the mold assembly to form the medicated treat;

disassembling the mold assembly by removing the mold plate and the base plate from the at least one mold clamp; and extracting the medicated treat from the mold assembly by aligning the at least one protrusion of the base plate with the at least one mold cavity of the mold plate, and pressing the base plate against the mold plate to extrude the medicated treat from the mold plate.

15. The method of claim 14, further including a step of packaging the medicated treat in a blister pack.

16. A medicated treat made in accordance with the method of claim 14.

* * * * *